US005647500A

United States Patent [19]

Konno et al.

[11] Patent Number: 5,647,500

[45] Date of Patent: Jul. 15, 1997

[54] PULL-TAB FOR LIQUID CONTAINER

[75] Inventors: Hidetoshi Konno, Yokohama; Masamichi Kaneko; Junichi Satoyoshi, both of Tokyo, all of Japan

[73] Assignee: Tetra Laval Holdings & Finance S.A., Pully, Switzerland

[21] Appl. No.: 677,176

[22] Filed: Jul. 9, 1996

Related U.S. Application Data

[63] Continuation of Ser. No. 455,495, May 31, 1995, abandoned.

[30] Foreign Application Priority Data

May 31, 1994 [JP] Japan ..... 6-142504

[51] Int. Cl.[6] ..... B65D 17/34

[52] U.S. Cl. ..... 220/269; 220/270; 220/712; 229/123.1; 229/123.2

[58] Field of Search ..... 220/268, 269, 220/270, 271, 272, 359, 259, 711, 712, 713, 703, 906; 215/232, 254, 255; 229/123.1, 123.2; 383/66, 210, 211

[56] References Cited

U.S. PATENT DOCUMENTS

| | | | |
|---|---|---|---|
| 3,952,911 | 4/1976 | Bozek et al. | 220/359 X |
| 4,039,101 | 8/1977 | Wells | 220/269 |
| 4,108,330 | 8/1978 | Patterson | 220/269 X |
| 4,189,060 | 2/1980 | Trotman, III | 220/269 X |
| 4,232,797 | 11/1980 | Waterbury | 220/269 X |
| 4,312,450 | 1/1982 | Reil | 229/123.2 |
| 4,582,216 | 4/1986 | Byrd | 220/259 |
| 4,674,649 | 6/1987 | Pavely | 220/269 X |
| 4,775,065 | 10/1988 | Shastal | 220/269 X |
| 4,988,012 | 1/1991 | Shastal | 220/269 X |

FOREIGN PATENT DOCUMENTS

| | | | |
|---|---|---|---|
| 004932 | 4/1979 | European Pat. Off. . | |
| 166483 | 6/1985 | European Pat. Off. . | |
| 256477 | 2/1988 | European Pat. Off. | 220/269 |
| 2393737 | 6/1978 | France . | |
| 2125761 | 3/1984 | United Kingdom | 220/269 |

OTHER PUBLICATIONS

European Search Report dated Sep. 7, 1995, Appl. No. 95303692.8.

*Primary Examiner*—Gary E. Elkins
*Assistant Examiner*—Nathan Newhouse
*Attorney, Agent, or Firm*—Loeb & Loeb LLP

[57] ABSTRACT

A pull-tab for a liquid container according to the present invention is designed in form of a sheet, and by providing a cutting line in form of a ring, leaving a connecting sector on the periphery, it comprises a handle sector, being the portion outside said cutting line, and a main sector, being the portion inside the cutting line. By providing another cutting line in convex arc in the direction away from the connecting sector on the main sector, a fastening sector is formed. In this pull-tab, the main sector covers the pouring mouth when the connecting sector is positioned near outer periphery of the pouring mouth of the liquid container. A sector between an end of the main sector opposite to the connecting sector and a fastening sector is bonded to the surface of the liquid container. When the handle sector is lifted up and the main sector is pulled up with edges of the bonded sector as a supporting axis, the fastening sector is turned, and its forward end is stopped on the surface of the liquid container.

2 Claims, 7 Drawing Sheets

PULL-TAB FOR LIQUID CONTAINER

This is a continuation of application Ser. No. 08/455,495 filed on May 31, 1995, now abandoned.

BACKGROUND OF THE INVENTION

The present invention relates to a pull-tab for a liquid container to be attached on a pouring mouth, i.e. an opening, of the liquid container.

Conventinally, a pouring mouth or an opening is provided on a liquid container, which is primarily made of paper or plastics, and the pouring mouth is attached and sealed with a pull-tab made of film-like sheet or resin. The mouth is unsealed by detaching the entire sheet or pull-tab.

However, when the entire sheet or the entire pull-tab is detached, the sheet or the pull-tab is turned to another type of refuse in addition to the liquid container itself. Thus, additional problem of refuse disposal occurs when these are thrown away.

To solve the problem, there have been proposed various methods, e.g. only a part of the sheet or the pull-tab is peeled off so that the sheet or the pull-tab itself is not detached from the liquid container.

In this case, however, when fingers are separated from the sheet or the pull-tab, the sheet or the pull-tab returns to its initial position and blocks the pouring mouth of the container.

SUMMARY OF THE INVENTION

It is an object of the present invention to provide a pull-tab for a liquid container, which is left on the container when the pouring mouth is unsealed and is not turned to refuse, and which does not block the pouring mouth of the container and can be produced in simple and easier manner.

To attain the above object, the pull-tab for a liquid container according to the present invention covers and seals a pouring mouth or opening of the liquid container made of paper or plastics, whereby said pull-tab is designed in sheet-like shape and by providing a cutting line in form of a ring, leaving a connecting sector on the periphery, it comprises a handle sector, being the portion outside said cutting line, and a main sector, being the portion inside the cutting line. By providing another cutting shaped as a curving line or bending line, where the convex part of said cutting line pointing to the direction away from the connecting sector on the main sector, a fastening sector is formed. Further, in the pull-tab as described above, the connecting sector is positioned near outer periphery of the pouring mouth of the liquid container and covers the pouring mouth by its main sector, and the portion between an end of the main sector opposite to the connecting sector and the fastening sector is bonded to the surface of the liquid container.

According to the present invention, when the handle sector is pulled up, it is lifted up with the connecting sector as a supporting point. Next, when the handle sector is pulled up further, the main sector is turned and lifted up with edges at the bonded sector as a supporting axis. Then, the pouring mouth is opened. When the main sector is lifted up to the position where it stands approximately in vertical direction, tip of the fastening sector is turned toward rear side from the surface of the main sector and is fastened on the surface of the liquid container. Therefore, even when fingers are separated from the handle sector under this condition, the main sector does not return to its initial position, and it is perfectly retained at its present position.

In other words, the pull-tab is maintained in unsealed condition once unsealed, and it does not block the pouring mouth.

When the pouring mouth of the liquid container is unsealed or opened, the pull-tab remains to be attached on the liquid container, and it is not turned to an additional refuse separate from the liquid container itself.

This pull-tab can be produced easily by simply cutting the sheet.

DESCRIPTION OF THE PREFERRED EMBODIMENTS

In the following, detailed description will be given on embodiments of the present invention in connection with the drawings.

Figure 1A:
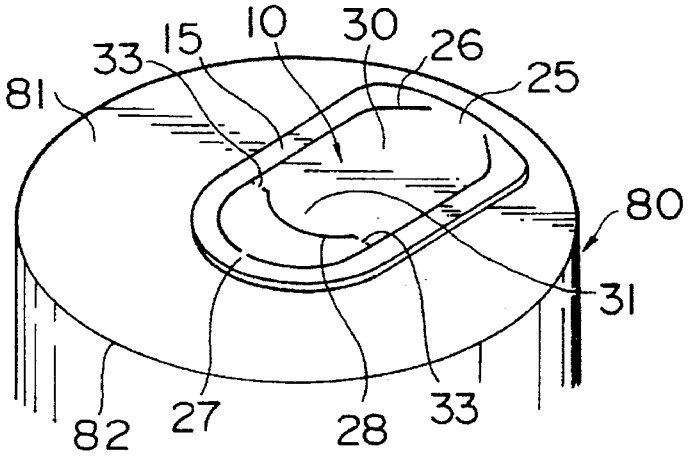
FIGS. 1 (A), (B) and (C) each represents a pull-tab for a liquid container according to a first embodiment of the present invention, where FIG. 1 (A) is a perspective view of the pull-tab, FIG. 1 (B) is a plan view, and FIG. 1 (C) is an enlarged cross-sectional view along the line 1 (C)—1 (C) in FIG. 1 (B).
Figure 1B:
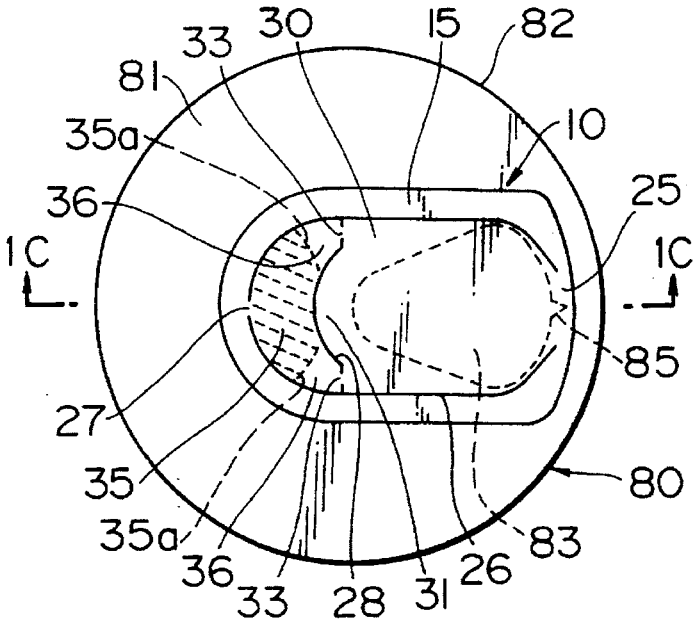
Figure 1C:
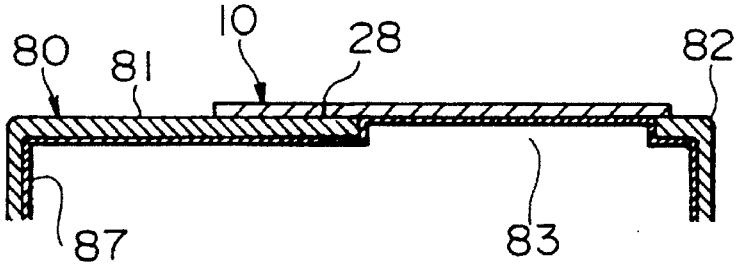

FIG. 1 represents a pull-tab for a liquid container according to a first embodiment of the present invention, where FIG. 1 (A) is a perspective view, FIG. 1 (B) is a plan view, and FIG. 1 (C) is an enlarged cross-sectional view along the line 1 (C)–1 (C) in FIG. 1 (B).

As shown in these figures, the pull-tab 10 is attached to cover a pouring mouth 83, which is provided on an upper plate 81 of a liquid container 80 made primarily of paper or plastics.

Here, on the pouring mouth 83 of the liquid container 80, a small projection 85 is provided, which protrudes in form of a triangle facing toward outer periphery 82 of the upper plate 81.

On the other hand, the pull-tab 100 is designed with a resin sheet in approximately elliptical shape. A cutting line is provided on outer periphery of the pull-tab in form of a ring (cutting line 26), leaving only a connecting sector 25 intact.

Thus, it comprises a handle sector 15, i.e. the portion outside the cutting line, and a main sector 30, i.e. the portion inside the cutting line. Opposite (by 180°) to the connecting sector 25 in the cutting line 26, a small portion is left uncut to leave a seal checking sector 27.

Also, in the main sector 30, a fastening sector 31 is formed by another cutting line in shape of a convex arc in the direction away from the connecting sector 25 (cutting line 28). On each end of the fastening sector 31, a bending sector 33 is provided so that the main sector 30 can be easily bent with these two ends as an axis as shown by the dotted cutting line.

The pull-tab 10 can be easily produced by two processes: a process to punch the external shape from a resin sheet and a process to provide cutting lines on the pull-tab 10 by a single cutting operation.

Then, the sector 35 (the sector shown by dotted diagonal lines in FIG. 1 (B)) between the end of the main sector 30 opposite to the connecting sector 25 and the fastening sector 31 is bonded to the upper plate 81 of the liquid container 80. However, sectors 36 and 36 between the bending sector 33 on each end of the fastening sector 31 and edges 35*a* of the bonded sector 35 are not bonded.

On the other hand, as shown in FIG. 1 (C), a thin resin film 87 is closely affixed to inner surface of the liquid container 80 and to the lower surface of the pull-tab 10 facing to the pouring mouth 83.

Figure 2A:
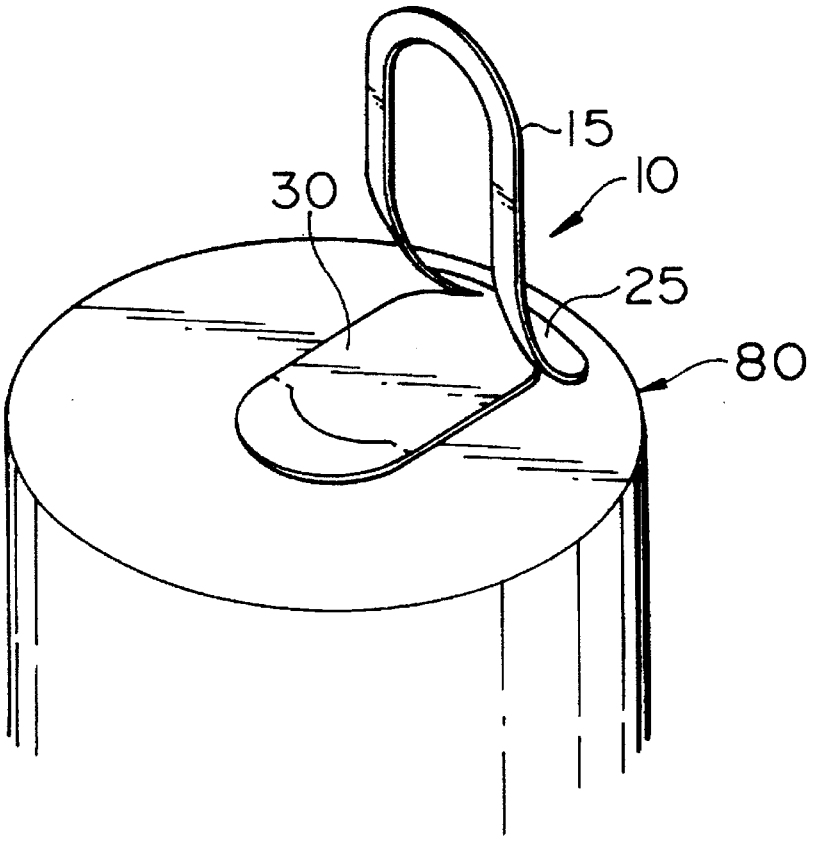
FIGS. 2 (A) and (B) each represents operation of a pull-tab 10, where FIG. 2 (A) is a perspective view, and FIG. 2 (B) is a cross-sectional view, which corresponds to the cross-section of FIG. 1 (C).
Figure 2B:
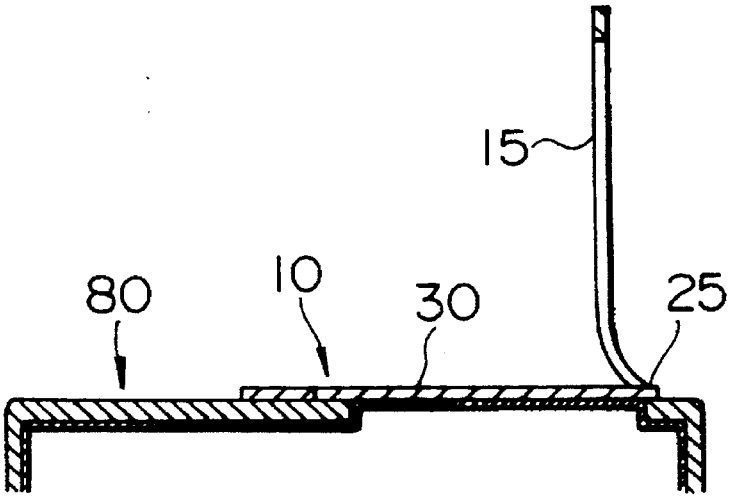
Figure 3A:
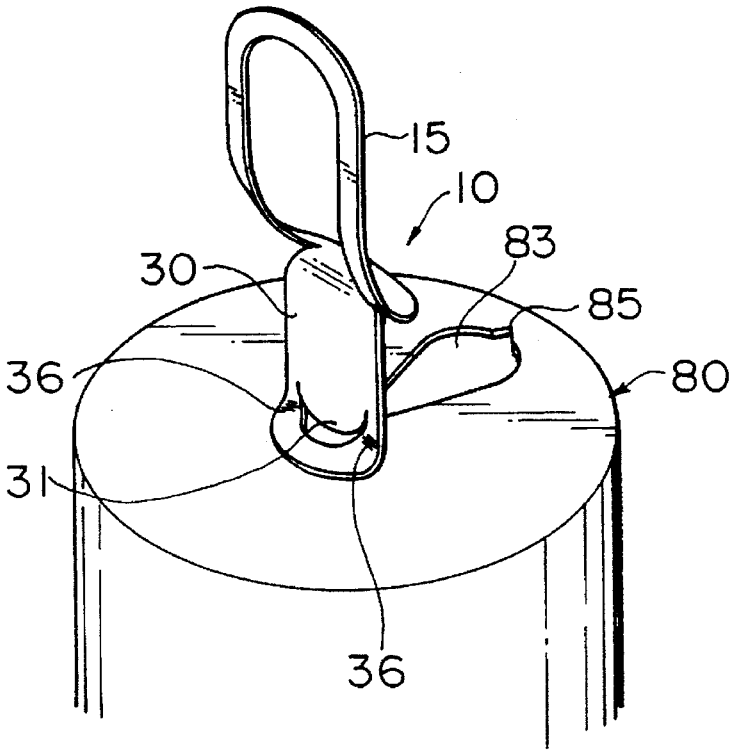
FIGS. 3 (A) and (B) each represents operation of a pull-tab 10, where FIG. 3 (A) is a perspective view, and FIG. (B) is a cross-sectional view (corresponding to the cross-section shown in FIG. 1 (C)).
Figure 3B:
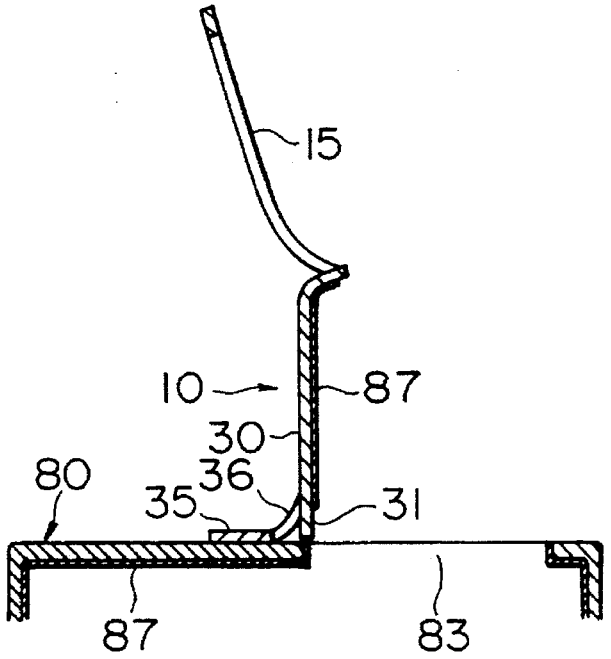
Figure 4A:
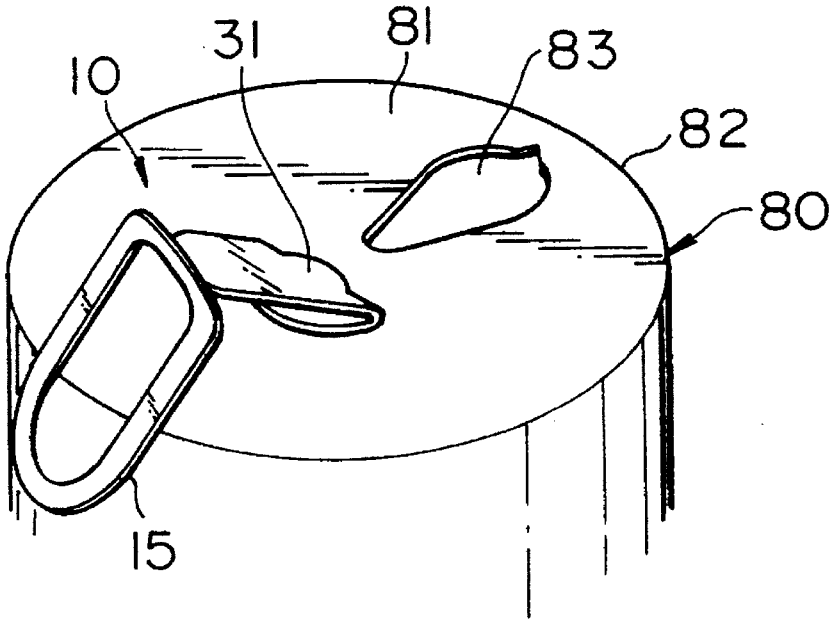
FIGS. 4 (A) and (B) each represents operation of a pull-tab 10, where FIG. 4 (A) is a perspective view, and FIG. 4 (B) is a cross-sectional view (corresponding to the cross-section in FIG. 1 (C)).
Figure 4B:
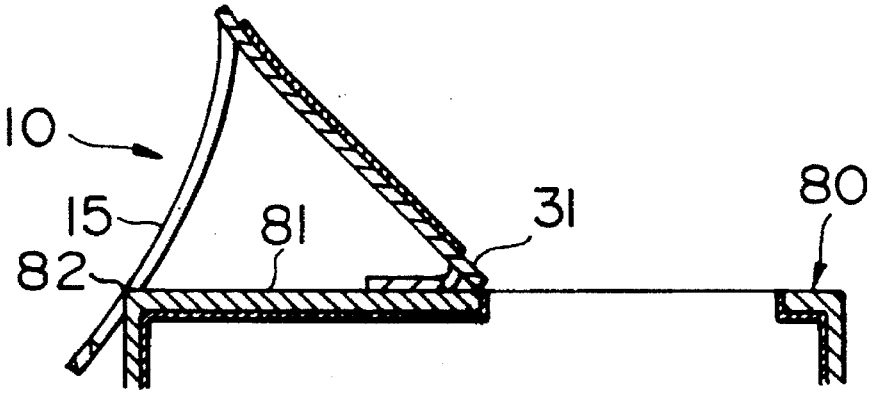
Figure 5A:
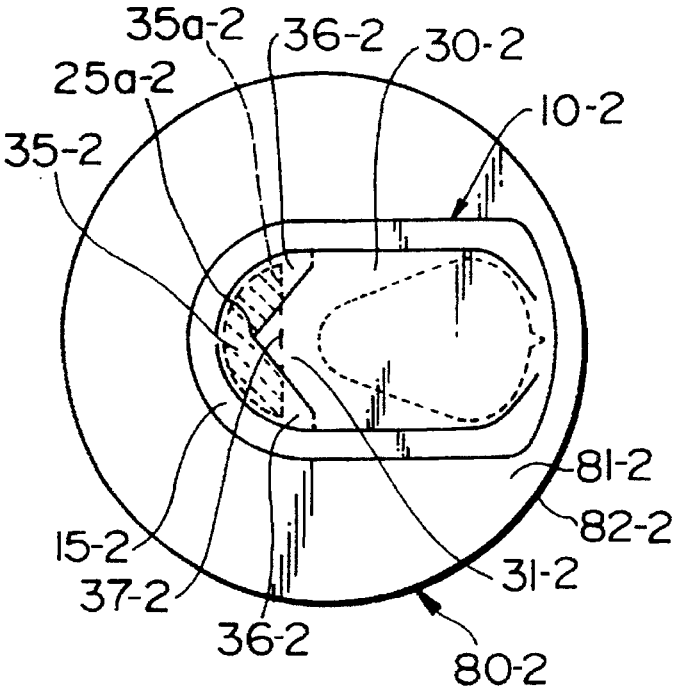
FIGS. 5 (A), (B), (C) and (D) each represents a pull-tab for a liquid container according to a second embodiment of the present invention, where FIG. 5 (A) is a plan view, FIG. 5 (B) is a perspective view showing only the pull-tab 10-2, FIG. 5 (C) is a side view showing the condition when the pull-tab 10-2 is opened, and FIG. 5 (D) is a perspective view showing only the pull-tab 10-2.
Figure 5B:
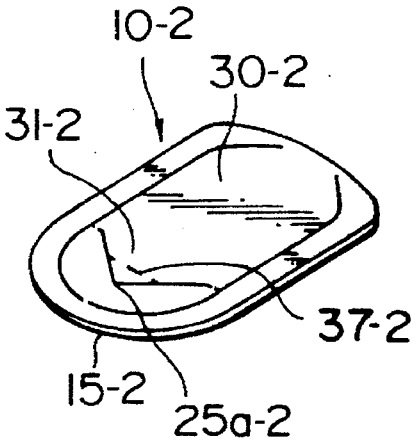
Figure 5C:
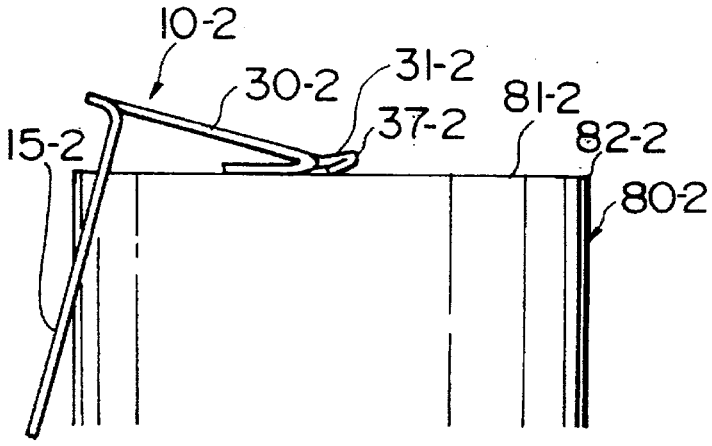
Figure 5D:
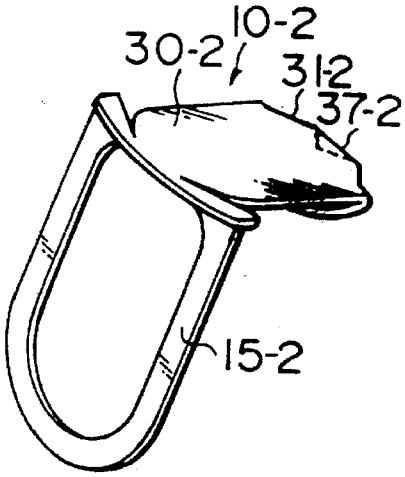
Figure 6A:
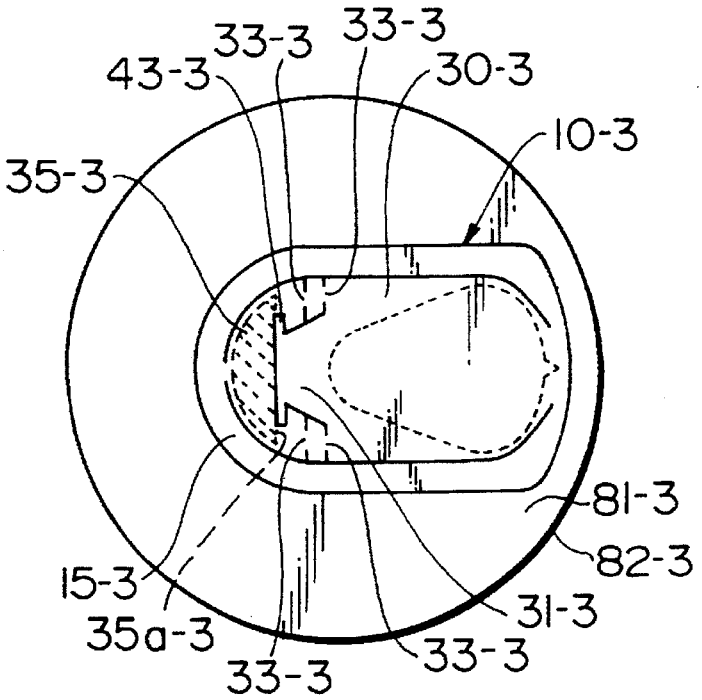
FIGS. 6 (A), (B), (C) and (D) each represents a pull-tab for a liquid container according to a third embodiment of the present invention, where FIG. 6 (A) is a plan view, FIG. 6 (B) is a perspective view showing only the pull-tab 10-3, FIG. 6 (C) is a side view showing the condition where the pull-tab 10-3 is opened, and FIG. 6 (D) is a perspective view showing only the pull-tab 10-3.
Figure 6B:
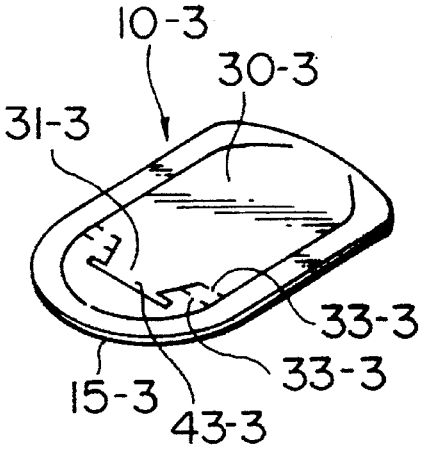
Figure 6C:
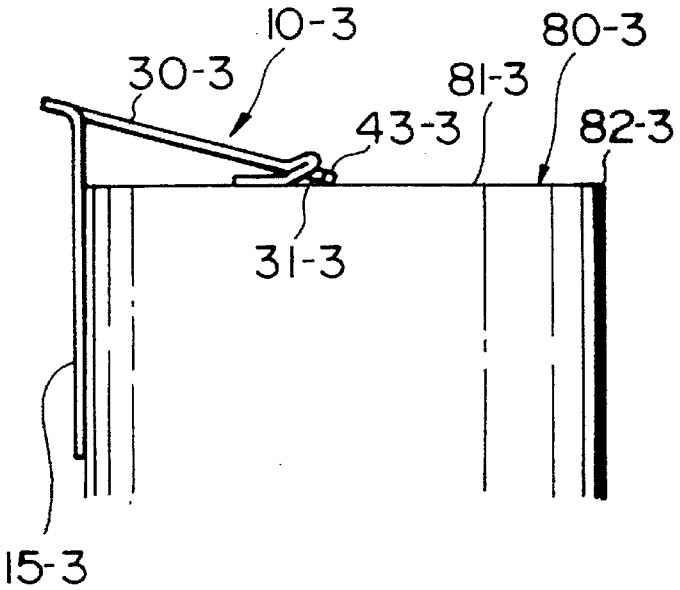
Figure 6D:
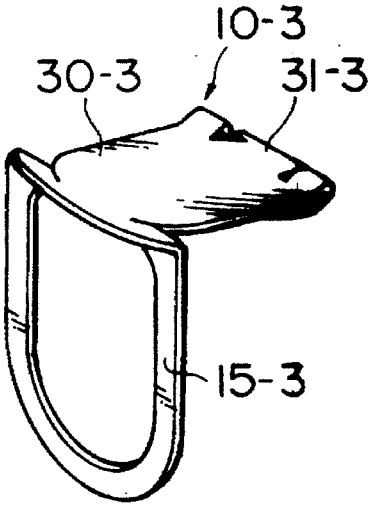

Next, description will be given on how the pull-tab 10 is used. FIG. 2 to FIG. 4 each represents operation of the pull-tab 10, where (A) is a perspective view, and (B) shows a lateral cross-sectional view.

Under the condition shown in FIG. 1, the handle sector 15 with the seal checking sector 27 on the pull-tab 10 is lifted up. Then, the seal checking sector 27 is torn off, and the handle sector 15 can be lifted up as shown in FIG. 2 with the connecting sector 25 as a supporting axis.

The seal checking sector 27 is provided to demonstrate that the pull-tab 10 is not yet unsealed, and it contributes to the prevention of falsification or tampering.

When the handle sector 15 is lifted up further, the main sector 30 is raised with the edges 35*a* and 35*a* of the bonded sector 35 (See FIG. 1 (B).) as the supporting axis as shown in FIG. 3. In this case, the film 87 is peeled off in shape of the pouring mouth 83 because it is affixed on lower surface of the main sector 30, and the pouring mouth 83 is opened. When the lifting of the main sector 30 is started, the lifting force is concentrated on the small projection 85 of the pouring mouth 83. Thus, the film 87 on the small projection 85 is easily peeled off, and this facilitates the subsequent peeling of the film 87.

When the main sector 30 is lifted up until it is erected almost in vertical direction as shown in FIG. 3, the sectors 36 and 36 are lifted up. As a result, the forward end of the fastening sector 31 is turned toward inner side from the surface of the main sector 30. Further, when the handle sector 15 is pulled backward and is stopped on the outer periphery 82, the fastening sector 31 is turned further and its forward end contacts the upper plate 81 of the liquid container 80. Accordingly, even when fingers are separated from the handle sector 15, the main sector 30 does not return to its initial position and is retained perfectly at its present position.

In this embodiment, the handle sector 15 is stopped on the outer periphery 82, while it may not be stopped at the outer periphery 82 and the tip of the handle sector 15 may be abutted to the upper plate 81.

FIG. 5 shows a pull-tab for a liquid container according to a second embodiment of the present invention, where FIG. 5 (A) is a plan view, FIG. 5 (B) is a perspective view showing only the pull-tab 10-2, FIG. 5 (C) is a side view showing the condition when the pull-tab 10-2 is opened, and FIG. 5 (D) is a perspective view of the pull-tab 10-2 in FIG. 5 (C).

The difference of this embodiment from the above first embodiment is in the fastening sector 31-2. Namely, as shown in FIGS. 5 (A) and (B), the fastening sector 31-2 is designed in such manner that its central convex portion 25*a*-2 is formed in shape of a horn. In the fastening sector 31-2, a bending sector 37-2 shown by a cutting line is provided so that the convex horn 25*a* of the fastening sector 31-2 can be easily bent. The edge 35*a*-2 of the bonded sector 35-2 is designed on the same straight line as the bending sector 37-2.

By the same procedure as described for the first embodiment, when the handle sector 15-2 of the pull-tab 10 is lifted up, the main sector 30-2 is raised. Further, the handle sector 15-2 is pulled backward as shown in FIG. 5 (C) and is stopped at the outer periphery 82-2 of the liquid container 80-2. In this case, the convex portion 25*a*-2 of the fastening sector 31-2 is bent along the cutting line 37-2 and is stopped on the upper plate 81-2 of the liquid container 80-2. Thus, the main sector 30-2 is reliably retained at the bent position.

In this embodiment, the main sector 30-2 can be retained at the more downward position than in the first embodiment because the convex portion 25*a*-2 of the fastening sector 31-2 is bent.

FIG. 6 shows the pull-tab for a liquid container according to a third embodiment of the present invention, where FIG. 6 (A) is a plan view, FIG. 6 (B) is a perspective view showing only the pull-tab 10-3, FIG. 6 (C) is a side view showing the condition where the pull-tab 10-3 is opened, and FIG. 6 (D) is a perspective view of the condition of the pull-tab 10-3 in FIG. 6 (C).

The difference of this embodiment from the first embodiment is in the fastening sector 31-3. Namely, as shown in FIGS. 6 (A) and (B), the fastening sector 31-3 is designed in approximately trapezoidal form and a portion with wider width 43-3 is formed at its top. On each end of the fastening sector 31-3, bending sectors 33-3 and 33-3 are provided in duplication consisting of dotted cutting lines so that the main sector 30-3 can be easily bent with these ends as an axis. It is also designed that the edges 35*a*-3 of the bonded sector 35-3 are on the same straight line as the top side of the wider portion 43-3.

By the same procedure as in the above first embodiment, the handle sector 15-3 of the pull-tab 10-3 is lifted up to raise the main sector 30-3, and the handle sector 15-3 is pulled backward as shown in FIG. 6 (C) and is stopped at the outer periphery 82-3 of the liquid container 80-3. Then, the main sector 30-3 is bent along the double cutting lines 33-3 and 33-3. At the same time, the wider portion 43-3 at the forward end of the fastening sector 31-3 is stopped on the upper plate 81-3 of the liquid container 80-3.

In this embodiment, the main sector 30-3 is bent along the double cutting lines 33-3 and 33-3, and the main sector 30-3 can be maintained at the more downward position than in the first embodiment. Because the wider portion 43-3 is provided on the forward end of the fastening sector 31-3, the pulled-down main sector 30-3 can be reliably retained at the downward position.

Figure 7:
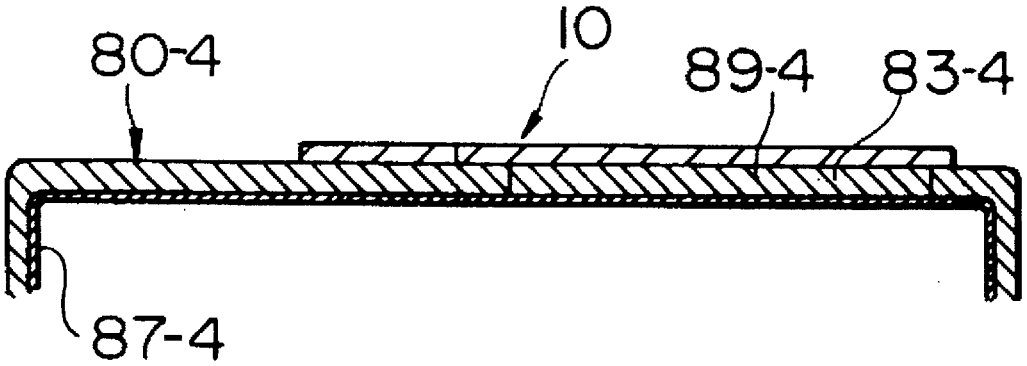
FIG. 7 is a cross-sectional view showing a sealing structure of another pouring mouth 83-4.

The structure to seal the pouring mouth is not limited to the structure of each of the above embodiments, and various other types of sealing structures as proposed in the past may be applied. For example, a cut portion 89-4 of the liquid container 80-4 may be left on the pouring mouth 83-4 as shown in FIG. 7, and a resin film 87-4 may be affixed on its lower surface and the pull-tab 10 may be attached on its upper surface. Although not shown, outer periphery of upper surface of the pouring mouth 83 of the liquid container 80 may be directly bonded on lower surface of the pull-tab.

It is needless to say that various changes and modifications may be made without departing the spirit and the scope of the present invention. The above embodiments are given only for exemplary purpose and the invention should not be construed as limited to these embodiments. The scope of the present invention is as set forth in the claims attached hereto and is not confined to the description in the specification. Further, any variation or modification within the scope of the claims should be considered as falling under the scope of the present invention.

What we claim is:

1. A pull-tab for covering and sealing a pouring mouth of a liquid container having a surface and a periphery, the pull-tab comprising:

a sheet having a first cutting line and a second cutting line, the first cutting line delimiting the pull-tab into first and second portions, the first portion of the pull-tab defining a main sector, the second portion of the pull-tab defining a handle sector, a third portion of the pull-tab defining a connecting sector positionable adjacent the periphery of the container, the main sector being configured to cover the pouring mouth of the container when the connecting sector is positioned adjacent the periphery of the container, the connecting sector being configured as a support point for the handle sector when the handle sector is pulled away from the surface of the container, the second cutting line being convexly curved away from the connecting sector and delimiting a fastening sector as a portion of the main sector, a bonded sector having at least a portion thereof bonded to the surface of the container and located adjacent the fastening sector, the bonded sector having unbonded edge areas configured as a support axis about which the main sector is turnable when the main sector is pulled away from the surface of the container, the fastening sector having at least a portion of an edge configured to contact the surface of the container when the main sector is pulled away from the surface of the container, the support axis being spaced from the pouring mouth so that the main sector is maintainable in a substantially stable position substantially perpendicular to the surface of the container when the main sector is pulled away from the surface of the container.

2. A pull-tab for covering and sealing a pouring mouth of a liquid container having a surface and a periphery, the pull-tab comprising:

a sheet having a first cutting line and a second cutting line, the first cutting line delimiting the pull-tab into first and second portions, the first portion of the pull-tab defining a main sector, the second portion of the pull-tab defining a handle sector, a third portion of the pull-tab defining a connecting sector positionable adjacent the periphery of the container, the main sector being configured to cover the pouring mouth of the container when the connecting sector is positioned adjacent the periphery of the container, the connecting sector being configured as a support point for the handle sector when the handle sector is pulled away from the surface of the container, the second cutting line delimiting a fastening sector as a portion of the main sector, a bonded sector having at least a portion thereof bonded to the surface of the container and located adjacent the fastening sector, the bonded sector having unbonded edge areas configured as a support axis about which the main sector is turnable when the main sector is pulled away from the surface of the container, the fastening sector having at least a portion of an edge configured to contact the surface of the container when the main sector is pulled away from the surface of the container, the support axis being spaced from the pouring mouth so that the main sector is maintainable in a substantially stable position substantially perpendicular to the surface of the container when the main sector is pulled away from the surface of the container.

* * * * *